US008439199B2

(12) United States Patent
Ravary et al.

(10) Patent No.: US 8,439,199 B2
(45) Date of Patent: May 14, 2013

(54) BEDDING SET ORGANIZER AND METHOD

(75) Inventors: Linda R. Ravary, Raleigh, NC (US); Michael Hexter, Encino, CA (US); Alexander Winstead, Encino, CA (US)

(73) Assignee: Ravary Enterprises LLC, Raleigh, NC (US)

( * ) Notice: Subject to any disclaimer, the term of this patent is extended or adjusted under 35 U.S.C. 154(b) by 0 days.

(21) Appl. No.: 13/246,339

(22) Filed: Sep. 27, 2011

(65) Prior Publication Data

US 2012/0074021 A1 Mar. 29, 2012

Related U.S. Application Data

(60) Provisional application No. 61/387,832, filed on Sep. 29, 2010.

(51) Int. Cl.
*B65D 73/00* (2006.01)
*B65D 85/00* (2006.01)

(52) U.S. Cl.
USPC ..... 206/494; 206/442; 206/451; 24/17 R

(58) Field of Classification Search ..... 206/494, 206/281, 278, 292, 451, 442, 812, 83.5, 459.5, 206/459.1; 40/661.04, 665; 229/87.15, 87.01; 294/149, 150, 138; 24/17 R, 16 R
See application file for complete search history.

(56) References Cited

U.S. PATENT DOCUMENTS 510,621 A * 12/1893 Van Derveer ..... 24/17 R
829,923 A * 8/1906 Lee ..... 206/440
978,591 A * 12/1910 Jayne ..... 24/17 R
1,135,853 A * 4/1915 Seach ..... 24/17 R
1,177,124 A * 3/1916 Michael ..... 24/17 R
1,192,152 A * 7/1916 Atkinson ..... 24/17 R
1,328,019 A * 1/1920 Stewart ..... 40/665
1,349,857 A * 8/1920 Salop ..... 24/17 R
1,886,227 A 11/1932 Riesner
2,268,845 A * 1/1942 Powers ..... 24/17 R
2,532,306 A * 12/1950 Herbert ..... 294/150
3,865,292 A * 2/1975 Foley ..... 294/149
3,933,287 A * 1/1976 Foley ..... 294/149
4,684,163 A * 8/1987 Anderson ..... 294/149
5,054,816 A * 10/1991 Rosengarten ..... 281/42
5,233,380 A * 8/1993 Marvy ..... 396/526
5,915,629 A * 6/1999 Ribeiro ..... 24/16 R
6,189,968 B1 * 2/2001 Emanuel et al. ..... 297/188.01
6,915,601 B2 * 7/2005 Davis et al. ..... 40/299.01
6,915,602 B2 * 7/2005 Davis et al. ..... 40/299.01
7,096,544 B2 * 8/2006 Lusardi ..... 24/306
7,464,975 B1 * 12/2008 Cox ..... 294/138
D654,955 S * 2/2012 Vruwink ..... D20/22
2003/0000858 A1 * 1/2003 Clark et al. ..... 206/326
2008/0042460 A1 * 2/2008 Fuchs ..... 294/150
2009/0294311 A1 * 12/2009 Caldwell ..... 206/281
2010/0018888 A1 1/2010 Hamilton
2010/0059410 A1 * 3/2010 Smith ..... 206/774
2010/0072794 A1 * 3/2010 Karovic ..... 297/188.2
2010/0186274 A1 * 7/2010 Diehl ..... 40/638
2010/0213094 A1 8/2010 McKay
2012/0125797 A1 * 5/2012 Foye et al. ..... 206/494

* cited by examiner

*Primary Examiner* — Steven A. Reynolds
(74) *Attorney, Agent, or Firm* — Cahn & Samuels, LLP

(57) ABSTRACT

Provided herein is a linen set organizer with a set of perpendicularly oriented intersecting straps having fastening elements on the distal ends to releasably fasten the straps around a linen set and secure the set and wherein the straps bear identifying indicia for easy identification of the bundled content.

10 Claims, 3 Drawing Sheets

BEDDING SET ORGANIZER AND METHOD

CROSS REFERENCE TO RELATED APPLICATIONS

This application is an application filed under 35 U.S.C. §111(a) claiming benefit pursuant to 35 U.S.C. §119(e)(1) of application Ser. No. 61/387,832, filed on Sep. 29, 2010, pursuant to 35 U.S.C. §111(b), the entire content of which is incorporated herein by reference.

FIELD OF THE INVENTION

This invention relates to an improved system for identifying and maintaining bed linens, sheets, bedding, and other folded fabric, sheet-like members in an orderly fashion when stacked during storage in a closet. The present invention provides for the organization, orderly storage, and simplified retrieval, particularly of sheet sets, linens, and bedding such as blankets, comforters and quilts.

BACKGROUND OF THE INVENTION

The maintenance of an orderly linen closet in a residence has always posed a challenge of time and effort. Despite expending such effort to impose order, the chaos of a neglected linen closet often prevails. After a period of time, the closet contains a jumble of disordered and comingled sheets of various sizes.

Many approaches have been used in an attempt to solve the linen closet organization problem. One such approach is to construct an ordered array of compartments or cubicles or dividers to retain sheet sets within the closet space. Another approach is to utilize stacks of boxes for storage of sorted or separated sheets. Permanent compartments or dividers typically entail significant installation cost, limit flexibility of utilization of the closet space, and prevent easy reconfiguration thereof. Boxes, while permitting a greater degree of flexible reconfiguration, occupy and can waste significant storage space. Furthermore, utilization of boxes may be ineffective in deterring the careless or sloppy user. It is easy to envision an organized linen set being "separated" by members of a household, who rummage through a box or boxes when searching for a particular sheet or linen size. Linens rejected during such a search typically remain unfolded and are returned to the closet in a haphazard fashion.

Pre-sized plastic pouches, and particularly those with a closure such as a zipper, present a different set of problems. For example, difficulty in alignment may be encountered when inserting the sheet into a pouch. The person attempting to organize the linen, will experience further frustration when the fabric of the sheet set gets caught in a zipper, the bag or pouch fastener breaks, or the bag rips. Disposable or limited use bedding bags also are not ecologically friendly.

Other attempts have been suggested for the purpose of assisting in the organizing and identification of linens. For example, U.S. Pat. No. 1,886,227 (Reisner) describes a multi-component adjustable linen band for bundling and maintaining linens in an organized fashion by frictionally retaining bundled linen. US published application US 2010-0186274 depicts linear strips of a length sufficient to wrap around folded linens joined at the overlap and preferably pre-marked with particular linen sizes. The stated purpose of the described bands is to facilitate identification of the set or sets of linens.

It appears that there remains a need in the art for a linen organization expedient which provides efficiency, by saving time and labor, effectiveness, by minimizing subsequent disturbance of ordered sheet sets, and allows for repeated use.

While the prior art cited reflects approaches which are more or less effective for certain aspects of bed linen closet organization, there is still a need for a simple, multi-use, and durable linen closet organization adjunct that is reliable, requires a minimum of effort and labor to implement, and is capable of reliably securing and identifying multi-piece linen bundles.

SUMMARY OF THE INVENTION

It is an object of the present invention to provide a solution to existing problems in the closet organization art.

It is another object of this invention to provide a system to maintain sets of linens in a tidy and organized manner.

It is an object of the present invention to provide a linen organizer which minimizes the effort required to retrieve, and the disturbance caused by such retrieval of, a select linen set from a closet.

It is an object of the present invention to provide an organizer with indicia facilitating the accurate retrieval of a desired set of corresponding linens from storage, while avoiding the need to open up the selected folded linens for dimensional verification by visual inspection.

It is a yet another object of the present invention to provide a simple, rugged, multi-use, non-damaging linen closet organizing adjunct.

A still further object of this invention is to provide a method of linen closet organization using an adjunct that secures a linen set in multiple dimensions and provides for easy identification of the bundled content.

These and other unstated objects of the invention are satisfied by a linen organizer, comprising: a central panel of a defined length width and thickness bearing select identifying indicia, said central panel lying in a first plane; a first flexible strap of a first select length connected to said panel and having a width less than the width of the central panel, a second flexible strap of a second select length connected to said central panel and having a width less than the width of the central panel, a third flexible strap of a third select length connected to said central panel and having a width less than the length of the central panel, and a fourth flexible strap of a fourth select length connected to said panel and having a width less than the length of the central panel; where said first and second straps are collinearly disposed in a first direction and said third and fourth straps are collinearly disposed in a second direction; where said first and second directions are substantially perpendicular and crossover at the central panel; and where each of said first, second, third, and fourth straps have a distal end with an upper and lower surface remotely spaced from the center panel; and where said upper surfaces of the distal ends of said first and third straps incorporate a first cooperating element of a fastening means and said lower surfaces of the distal ends of said second and fourth straps incorporate a second cooperating element of a fastening means; where confronting the distal ends of said first and second straps and said third and fourth straps, respectively, and engaging said first and second cooperating elements fastens the respective distal ends together in a second plane and substantially underlying said central panel.

Still further objects of the invention are satisfied by a linen set organizer, comprising: a first strap, a second strap, a third strap and a fourth strap, each having a distal end, said first and third straps extending collinearly in a first direction and said second and fourth straps extending collinearly in a second direction which is substantially perpendicular to the first direction, said first second, third, and fourth straps each including an upper and lower surface where the upper surface incorporates a first select identifying indicia and the lower surface incorporates a second select identifying indicia; said first and second straps incorporating at their respective distal ends a first cooperating element of a releasable fastener member on at least one of the upper and lower surfaces; and said third and fourth straps incorporating at their respective distal ends a second cooperating element of a releasable fastener member on at least one of the upper and lower surfaces; where said fastener members are established by engaging the first and second cooperating elements to secure the distal end of the first and third straps and the second and fourth straps respectively to securely bundle a linen set in three dimensions for storage.

Objects of the invention are also satisfied by a linen set organizing method utilizing a linen set bundling adjunct, including a first strap, a second strap, a third strap and a fourth strap, each having a distal end, said first and third straps extending collinearly in a first direction and said second and fourth straps extending collinearly in a second direction which is substantially perpendicular to the first direction, said first second, third, and fourth straps each including an upper and lower surface where the upper surface incorporates a first select identifying indicia and the lower surface incorporates a second select identifying indicia, said first and second straps incorporating at their respective distal ends a first cooperating element of a releasable fastener member on at least one of the upper and lower surfaces, said third and fourth straps incorporating at their respective distal ends a second cooperating element of a releasable fastener member on at least one of the upper and lower surfaces, said method comprising the steps of: laying the adjunct on a flat supporting surface with a select identifying indicia juxtaposed thereon, where the first and third straps extend in a first axial direction and the second and fourth straps extend in a second axial direction orthogonal to the first axial direction; laying a folded linen set medially on the adjunct; folding the first strap over the linen set; folding the third strap over the linen set; establishing said fastener member by engaging the first and second cooperating elements to secure the distal ends of the first and third straps thereby fastening the distal ends of the first and third straps in a fashion to frictionally engage the linen set; folding the second strap over the linen set; folding the fourth strap over the linen set; and establishing said fastener member by engaging the first and second cooperating elements to secure the distal ends of the second and fourth straps in a fashion to frictionally engage the linen set and create a secured bundle; where the exposed indicia on the straps identify the content of the secured bundle.

The present invention provides for more efficient use of closet storage and shelf space while offering ready identification of the size of the linen sets stored within the device. Use of the invention obviates the need for persons to rummage through and upset the organization of stored linen sets by reliably maintaining the integrity of the linen sets secured, retained and identified by the invention. In short, the present invention is an assistive adjunct and method for organizing, storing, identifying and retrieving a particular matched set comprising a plurality of individual fabric items, such as bottom and top bed sheet sets with matching pillow cases. Of course, it is also usable in the context of the organization, storage, identification and retrieval of any foldable textiles such as blankets, comforters, quilts, towels and towel sets.

As used herein, the terms "hook-and-pile fasteners" and "hook-and-loop fasteners" refer to a recognized structure which is commercialized under the trademark Velcro®, in which the hook material and the pile or loop material engage one another. In particular, "hook type material", as used herein, refers to any material having a fastening system joined to and projecting from a substrate that features projecting mechanical engaging members capable of penetrating and engaging a confronting "pile" or "loop material" surface. The term "pile" or "loop material" surface, as used herein, refers to a hook-ensnaring fiber material that requires substantial force to separate after engagement.

For definitional purposes and as applicable, the strap end or portion positioned at or within the central panel/plate is referred to as "proximal" and the strap end remote from the central panel/plate is referred to as "distal."

As used herein "connected" includes physical, whether direct or indirect, permanently affixed or adjustably mounted. Thus, unless specified, "connected" is intended to embrace any operationally functional connection. The term "juxtaposed" means confronting or facing.

As used herein "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

In the following description, reference is made to the accompanying drawings which are provided for illustration purposes as representative of specific exemplary embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

BRIEF DESCRIPTION OF THE DRAWINGS

The present invention will become more readily apparent by describing in detail illustrative, non-limiting embodiments thereof with reference to the accompanying drawings, in which.

DETAILED DESCRIPTION OF ILLUSTRATIVE, NON-LIMITING EMBODIMENTS

Exemplary, non-limiting, embodiments of the present invention are discussed in detail below. While specific configurations and dimensions are discussed to provide a clear understanding, it should be understood that the disclosed dimensions and configurations are provided for illustration purposes only. A person skilled in the relevant art will recognize that other dimensions and configurations may be used without departing from the spirit and scope of the invention.

Figure 1:
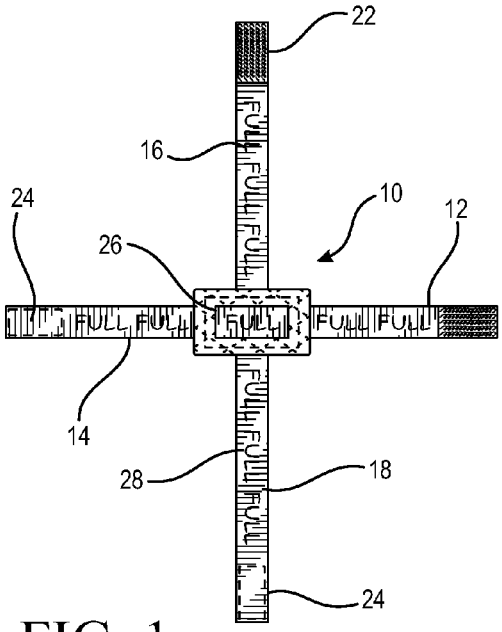
FIG. 1 illustrates the top view of an embodiment of the invention as used to bind a set of full sheet sized bed linen.
Figure 2:
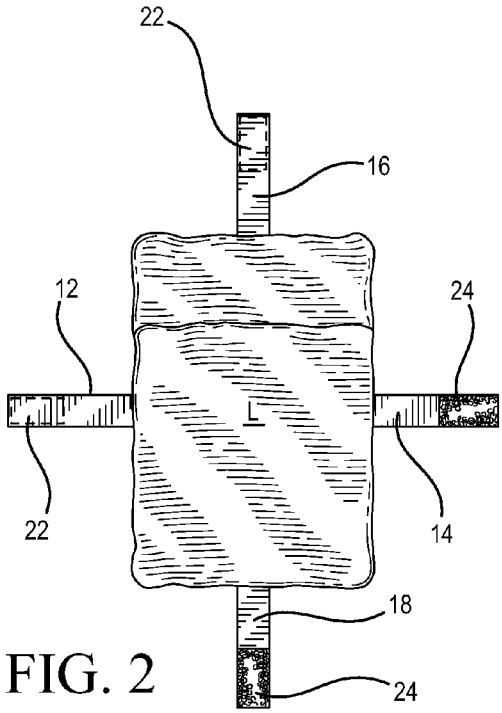
FIG. 2 is a bottom assembly view of the embodiment of FIG. 1 with a set of folded linen bundle positioned thereon.

As depicted in FIG. 1, a linen set bundle retaining device 10 for a "full" sized linen set according to one embodiment of the invention comprises substantially orthogonally oriented straps 12, 14, 16, and 18 in the form of a cross. The horizontally oriented straps, right strap 12 and left strap 14 preferably are formed from a single length of flexible and stretchable fabric webbing of between approximately 1 to 4 inches (2-10 cm), and preferably 1.5 inches (3 cm), wide.

The length of each horizontal strap 12 and 14 is sufficient to envelop a folded linen set (in the case of a "Full" size sheet set, in a range from 10 to 18 inches or 25-45 cm) while the length of the vertically oriented straps 16 and 18 are each about 20 percent longer than the horizontal straps (12 inches to 21 inches 30-53 cm). Preferably the combined length of the horizontal straps is approximately 25 inches (25 cm) and the vertical straps approximately 30 inches (76 cm). Each of the straps features a part of a cooperating fastener disposed at its distal end.

The length of vertical straps 16 and 18 is greater than that of their horizontal counterparts in order to accommodate the longer side of rectangularly oriented linen bundles. As in the case of their horizontal counterparts, each of the straps features a fastener disposed at its distal end, where the vertical strap 16 includes an integrated strip 22 of hook-type material disposed on its outer surface and the vertical strap 18 incorporates a similarly sized and disposed loop material 24 disposed on its inner surface. When formed of a Velcro®-type hook and loop fastening material, a strip length ranges from 1 to about 6 inches (2-15 cm) and, preferably, is about 4 inches (10 cm).

Preferably, the horizontal straps are comprised of a single piece of webbing, as are the vertical straps, preferably stitched together at the intersection. They are orthogonally disposed and cross over at or near their respective midpoints where the intersection underlies a crossover retaining a robust rectangular retainer panel/plate 26 to which they are preferably affixed by stitching, mechanical coupling, gluing or the like. Alternatively, the straps may not be positionally affixed to but slidingly retained by the panel/plate 26. In this variation, the retainer panel/plate 26 features opposing pairs of slots (not illustrated) through which the either or both of the respective straps pass and to be slidingly repositionable relative to the panel/plate 26. Such adjustability can be utilized when securing a particular linen bundle. The length of the elastic straps is variable, according to the size of the sheet set which is intended to be stored by the illustrated embodiment of the invention. In addition to the stretchable character of the illustrated elastic straps, when using Velcro® as the fastener, the length of the formed strap loop may be adjusted to accommodate sheets of the different thread counts or fabric thicknesses.

As depicted in FIG. 1, the surface of both the retaining panel 26 and the straps 12, 14, 16, and 18 feature sizing identifying indicia, in this case "FULL", to facilitate ready identification of the linen set size corresponding to the particular organizer 10 employed. Such indicia may take the form of a commonly employed word, as illustrated, or rely on a symbol for each sheet size and even may incorporate size coordinated colors corresponding to a particular linen size, to assist a user in easy visual identification, particularly when a plurality of bundled linen sets are in a stacked configuration on a closet shelf. One example of such a color scheme employs red for a Twin set, blue for a Full set, green for a Queen set, purple for a King set and orange for a California King set. Furthermore the invention is readily adaptable for use by the visually impaired by substitution of tactile indicators (e.g., raised letters) and/or Braille.

The theory of use of the above-described embodiment is now described in relation to FIGS. 2-7. The first step involves laying the organizer, exterior (indicia bearing side) down, on a flat supporting surface (e.g., table, bed, washing machine top, etc.). The strap 12 should be horizontally disposed on the left side of the central panel and the strap 14 disposed on the right. The longer straps 16 and 18 are disposed on the vertical axis and centered on the length of the central panel 26.

Figure 3:
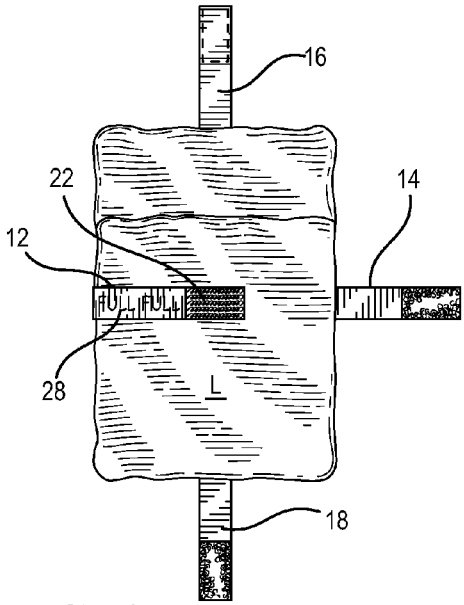
FIG. 3 is a further bottom assembly view of the embodiment of FIG. 1 showing strap 12 in the linen bundle securing position.
Figure 4:
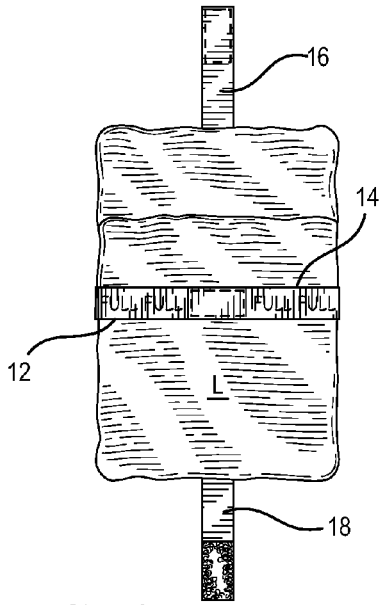
FIG. 4 is a further bottom assembly view of the embodiment of FIG. 1 showing strap 14 removably affixed to strap 12 and laterally securing the linen bundle.

The user then places a rectangular folded set of Full Size Linen L (bottom sheet, top sheet and pillow cases) on the organizer 10 to be aligned over the panel 26 and oriented so that the longer side of the rectangle is aligned with the longer straps 16 and 18. The horizontal strap 12 is folded over onto the linen set L, as illustrated in FIG. 3, where both the identifying indicia and the hook-type fastener material 22 integrated with strap 12's distal end are exteriorly disposed. The strap 14 is similarly folded over the longer edge of the rectangular linen set L and brought into an overlapping and confronting relationship with the hook fastener material 22. The user presses and secures the fastening elements together to form a retaining loop for the linen, in a separate plane overlying the central panel 26, as illustrated in FIG. 4.

Figure 5:
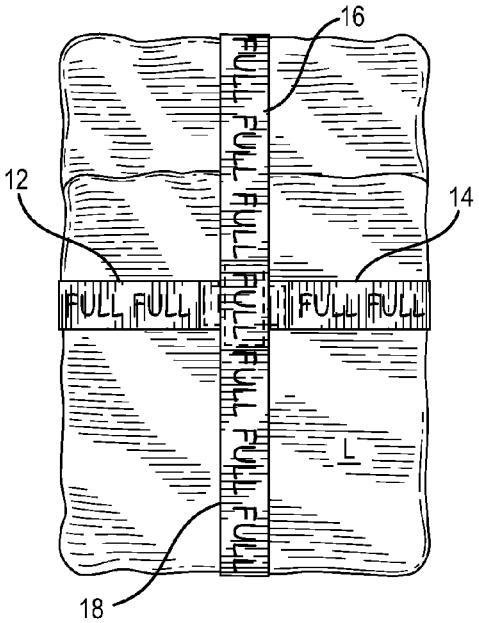
FIG. 5 is a further bottom assembly view of the embodiment of FIG. 1 showing the vertically oriented straps secured around the linen bundle.
Figure 6:
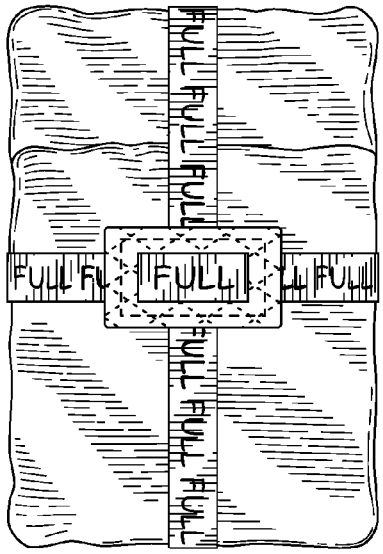
FIG. 6 is a top view of a twin sized set of linens folded, by example, in a rectangular configuration and fully secured by a "TWIN" embodiment of the invention.
Figure 7:
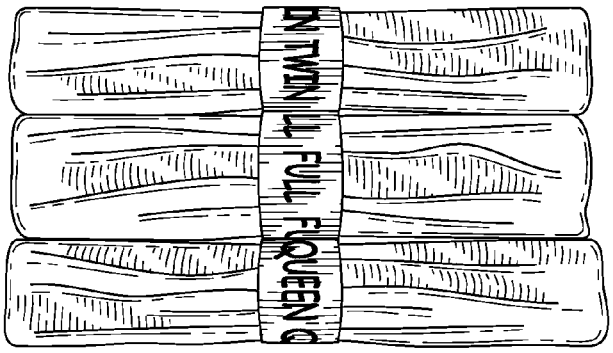
FIG. 7 is an elevational view of a stack of bundled linen sets, which have each been secured by the invention.
Figure 8:
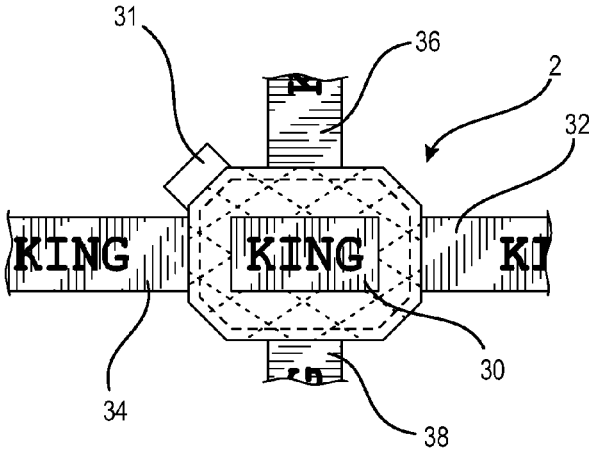
FIG. 8 is a depiction of a center panel portion of a second illustrated embodiment of the invention.
Figure 9:
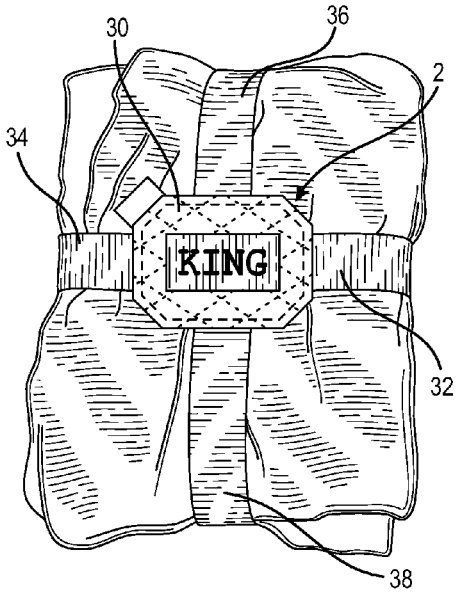
FIG. 9 is a depiction of a King size linen set bundle secured by the embodiment of FIG. 8.
Figure 10:
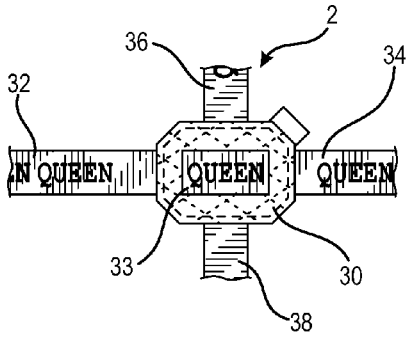
FIG. 10 is a depiction of the center panel portion of the reverse side of the second illustrated embodiment of FIG. 8.
Figure 11:
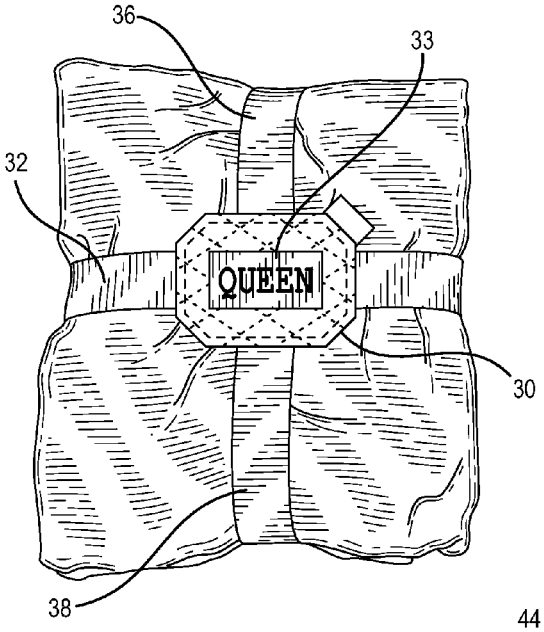
FIG. 11 is a depiction of a Queen size linen set bundle secured by the embodiment of FIG. 8.

Then the user folds the vertically oriented straps over the Linen set L in a similar manner and secures the fasteners at the respective distal ends together as illustrated in FIG. 5, thus establishing a bundled linen set, fully secured by frictional engagement of two perpendicularly disposed, close-fitting loops in three dimensions, while providing ready access (visual or tactile) to the identifying indicia. The user inverts the bundled and bound set which is now ready for storage in the closet or on a shelf, as in the example of the Twin set illustrated in FIG. 6, and where it may then be neatly stacked with other bound sets on a closet shelf, as illustrated in FIG. 7.

Turning now to the second illustrated and described embodiment of the invention, reference is made to FIGS. 8-12 that provides the "2 in 1" or reversible device 2. This second embodiment incorporates much of the structural detail of the above-described first embodiment but introduces reversibility and multiple use from the same device. Reversibility is achieved by employing color-coding and sizing indicia on both sides of the device, such that the single device is capable of enclosing and identifying two different sized linen sets, e.g., Twin and Full or Queen and King.

In the case of the reversible device 2 for Queen/King sheet sets, the obverse or upper face of the retaining panel 30, incorporating the indicia bearing patch 31, and the straps 32, 34, 36, and 38, bear the designation "KING", which may be color coded, for example, using purple to denote "King." On the reverse side, referred to as the lower face for convenience, the retaining panel 30 incorporates indicia bearing patch 33, in this case "QUEEN", which is color coded (for example, using green) and the lower faces of the straps 32, 34, 36, and 38 bear identifying indicia coordinated with patch 33. Although not illustrated, a smaller version of the reversible device according to the invention would be adapted for Twin and Full linen sets, where the retaining panel and the straps bear, on the obverse, the indicia and coordinated color, e.g., red designating "Twin" size, and, on the reverse, blue designating a "Full" set.

Among the structural differences between the first and second embodiments include the make up of the retaining panel. In this second embodiment, the panel 30 is formed of two pieces of octagonal, quilted fabric, either laminated or sewn together to overlie the intersection of the horizontal and vertically disposed straps, which may be securely stitched together at the crossover. The panel may include some rigidifying reinforcement to provide an enhanced degree of stiffness. However, too much stiffness is undesirable because it may cause the panel to poke into or otherwise damage the underlying bound linen set during storage. The use of the illustrated, thick quilted fabric with gently angled, multisided polygon (as illustrated, an octagon) or rounded edging minimizes the potential for the contained linen set to be damaged when jostled or shifted around during storage in a linen closet. In this particular embodiment, the irregular octagonal panel has a maximum length of approximately 5 inches (13 cm) and a maximum width of approximately 3.5 inches (9 cm)

In this second, reversible embodiment, the strap length must also be capable of accommodating the intended multiple linen set sizes. The multi-use of the device is achieved in the case of a Twin/Full device when the horizontal straps (32, 34) have a combined length of approximately 25 inches (63 cm) and the vertically oriented straps (36, 38) have a combined length of approximately 30 inches (76 cm). In the case of the Queen/King device, those dimensions increase to approximately 29 inches (73 cm) for the horizontal straps and approximately 34 inches (86 cm) for the vertical straps.

The second, reversible embodiment may feature, but preferably does not require, complementary fastening elements disposed on both surfaces of the distal ends 50. It is only necessary for one distal surface to incorporate a one of the two cooperating fastening elements. For example, only the upper surface the ends of straps 32 and 36 incorporate the hook portion of the fastener while only the lower or obverse surface of straps 34 and 38 incorporate the complementary fastening element, e.g., loop portion. Eliminating redundant multi-surface disposition of each of the fastening elements reduces material cost and simplifies production of the reversible embodiment of the invention.

In a variation of the preferred embodiments, the horizontal strap (32, 34) comprising a single continuous length of material may be fixed (for example, by sewing) to the retaining panel. The vertical strap (36, 38) comprising one continuous length is slidably engaged to the retaining panel 30 through slots to slide positionally relative thereto. Such adjustability of the vertical strap position in securing the bundled linen set may improve the line of sight to the color and sizing indicia, once the bundled linen set is placed for storage on a shelf or in a closet.

Figure 12:
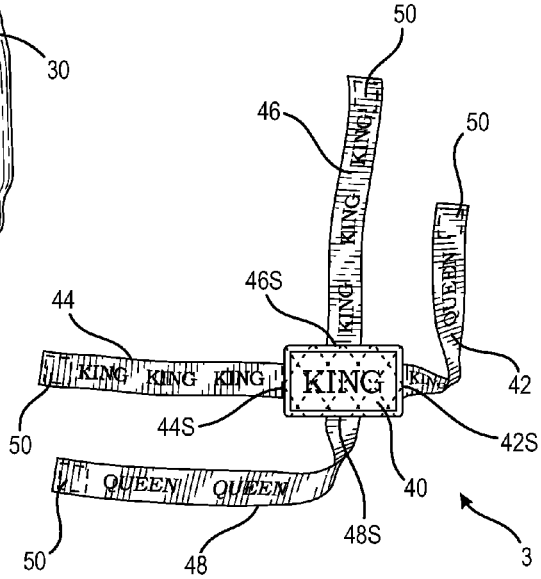
FIG. 12 illustrates a further embodiment of the invention.

FIG. 12 represents a further embodiment of the reversible invention, where the rounded edged, generally rectangular center panel/plate 40 features pairs of slots 42S, 44S, 46S, 48S adapted to slidingly receive, respectively, straps 42, 44, 46, and 48. In this manner, the organizer device is adjustable in two dimensions, which, as noted above, may provide improved alignment with line-of-sight to the indicia for stored, bundled linen sets. In this variation, preferably, the slots have a depth less than that of the thickness of the distally positioned fastener elements to prevent separation of the straps from the panel.

In yet another variation of the preferred embodiments, a device for a King sheet set may be complemented with a removable tag to indicate that the enclosed sheet set is a California King sheet set. Using such a removable tag is a more flexible approach than storing separate devices specifically for the relatively unusual "California King" sheet size.

It is understood that the retaining panel and/or the straps may have different sizes, shapes or carry different designs than those illustrated and that such differences may be for aesthetic reasons, such as suiting the invention better to different commercial and residential situations. Such variations in design do not change the utility of the invention.

Any flexible material, whether natural or synthetic, solid or woven, stretchable or not, can be employed for the straps, so long as the material is rugged, durable, and non-damaging to the linen. Additionally without departing from the scope of the invention, the above-described, Velcro® style strap end fasteners may be substituted for by other mechanical means such as hermaphroditic mushroom-type fasteners, buttons or even snaps. Although less desirable from a durability perspective the strap end fastening could also be accomplished with reusable, releasable adhesive strips.

Although only certain embodiments of the invention have been described and illustrated in the forgoing, it should be readily appreciated and understood by those skilled in the art that many other modifications and embodiments of the invention will come to mind to which the invention pertains, having benefit of the teaching presented in the foregoing description and associated drawings. It is therefore intended that the invention is not limited to the specific embodiments disclosed herein, and that those modifications and other embodiments of the invention fall within the scope of the invention.

What is claimed is:

1. A reversible linen organizer, comprising:

a central panel of a defined length, width and thickness, bearing select identifying indicia, said central panel lying in a first plane;

a first flexible strap of a first select length connected to said central panel and having a width less than the width of the central panel, a second flexible strap of a second select length connected to said central panel and having a width less than the width of the central panel, a third flexible strap of a third select length connected to said panel and having a width less than the length of the central panel, and a fourth flexible strap of a fourth select length connected to said panel and having a width less than the length of the central panel where the central panel is substantially smaller than the first, second, third, and fourth lengths and where each of the straps includes a first and a second surface;

where the first, second, third and fourth straps bear indicia corresponding to the select identifying indicia formed on both the first and second surfaces;

where said first and second straps are collinearly disposed in a first direction and said third and fourth straps are collinearly disposed in a second direction;

where said first and second directions are substantially perpendicular and crossover at the central panel;

where each of said first, second, third, and fourth straps have a distal end with an upper and lower surface remotely spaced from the central panel;

where said upper surfaces of the distal ends of said first and third straps incorporate a first cooperating element of a fastening means and said lower surfaces of the distal ends of said second and fourth straps incorporate a second cooperating element of a fastening means;

where confronting the distal ends of said first and second straps and said third and fourth straps, respectively, and engaging said first and second cooperating elements fastens the respective distal ends together in a second plane and substantially underlying said central panel;

where said first, second, third and fourth straps are formed from a resilient webbing and said first cooperating element is a hook fastener and said second cooperating member is a loop pile;

where said first and second straps are formed from a first continuous piece of webbing and said third and fourth straps being formed from a second piece of continuous webbing, where said first and second continuous pieces of webbing overlap and are stitched together at said overlap; and where the central panel has an upper surface bearing first select identifying indicia and a lower surface bearing second select identifying indicia and the first, second, third and fourth straps bear indicia respectively corresponding to the first and second select identifying indicia bearing surface of the central panel.

2. The organizer of claim 1 where the widths of said first, second, third and fourth straps are substantially equal and said first and second select lengths are substantially equal and third and fourth select lengths are substantially equal.

3. The organizer of claim 1 where the central panel comprises a flexible material.

4. The organizer of claim 3 where central panel is fabric.

5. A reversible linen organizer, comprising:

a central panel of a defined length, width and thickness, bearing select identifying indicia, said central panel lying in a first plane;

a first flexible strap of a first select length connected to said central panel and having a width less than the width of the central panel, a second flexible strap of a second select length connected to said central panel and having a width less than the width of the central panel, a third flexible strap of a third select length connected to said panel and having a width less than the length of the central panel, and a fourth flexible strap of a fourth select length connected to said panel and having a width less than the length of the central panel where the central panel is substantially smaller than the first, second, third, and fourth lengths and where each of the straps includes a first and a second surface;

where the first, second, third and fourth straps bear indicia corresponding to the select identifying indicia formed on both the first and second surfaces;

where said first and second straps are collinearly disposed in a first direction and said third and fourth straps are collinearly disposed in a second direction;

where said first and second directions are substantially perpendicular and crossover at the central panel;

where each of said first, second, third, and fourth straps have a distal end with an upper and lower surface remotely spaced from the central panel;

where said upper surfaces of the distal ends of said first and third straps incorporate a first cooperating element of a fastening means and said lower surfaces of the distal ends of said second and fourth straps incorporate a second cooperating element of a fastening means;

where confronting the distal ends of said first and second straps and said third and fourth straps, respectively, and engaging said first and second cooperating elements fastens the respective distal ends together in a second plane and substantially underlying said central panel;

where said first, second, third and fourth straps are formed from a resilient webbing and said first cooperating element is a hook fastener and said second cooperating member is a loop pile;

where said first and second straps are formed from a first continuous piece of webbing and said third and fourth straps being formed from a second piece of continuous webbing, where said first and second continuous pieces of webbing overlap and are stitched together at said overlap;

where the central panel comprises a flexible material; and where said central panel is slotted to slidingly receive and retain at least said first and second straps to permit movement thereof relative to the central panel.

6. A linen set organizer, comprising:

a first strap, a second strap, a third strap and a fourth strap, each having distal end, said first and third straps extending collinearly in a first direction and said second and fourth straps extending collinearly in a second direction which is substantially perpendicular to the first direction to establish an intersection of the straps, said first second, third, and fourth straps each including an upper and lower surface where the upper surface incorporates a first select identifying indicia and the lower surface incorporates a second select identifying indicia;

a retaining plate having upper and lower surfaces where the upper surface incorporates said first select identifying indicia and the lower surface incorporates a second select identifying indicia, said retaining plate overlying the intersection of said straps and retaining the proximal strap ends in a first plane in a manner where the distal ends of the first and third straps and the second and fourth straps overlie the retaining plate in a second plane;

said first and second straps incorporating at their respective distal ends a first cooperating element of a releasable fastener member on at least one of the upper and lower surfaces; and said third and fourth straps incorporating at their respective distal ends a second cooperating element of a releasable fastener member on at least one of the upper and lower surfaces;

where said fastener members are established by engaging the first and second cooperating elements to secure the distal end of the first and third straps and the second and fourth straps respectively to securely bundle a linen set in three dimensions for storage.

7. The linen set organizer of claim 6 where the first and third straps are formed of a single continuous piece of flexible material and said second and fourth straps are formed of a second single continuous piece of flexible material where the first and third straps intersect and overlie the second and fourth straps.

8. The linen organizer according to claim 7 where the retaining plate is formed from quilted fabric.

9. The linen organizer according to claim 7 where the retaining plate includes strap receiving slots to permit relative movement of said first and third straps relative to said second and fourth straps in said first plane.

10. The linen organizer according to claim 7 where the releasable fastener member is selected from the group consisting of hook-and-loop pile, hermaphroditic mushroom-type fasteners, buttons and snaps.

* * * * *